US007742025B2

(12) United States Patent
Sung et al.

(10) Patent No.: US 7,742,025 B2
(45) Date of Patent: Jun. 22, 2010

(54) DISPLAY APPARATUS AND DRIVING METHOD THEREOF

(75) Inventors: Si-Duk Sung, Seoul (KR); Kyong-Tae Park, Uijeongbu-si (KR); Nam-Deog Kim, Yongin-si (KR); Chun-Seok Ko, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 626 days.

(21) Appl. No.: 11/535,167

(22) Filed: Sep. 26, 2006

(65) Prior Publication Data

US 2007/0075938 A1 Apr. 5, 2007

(30) Foreign Application Priority Data

Sep. 30, 2005 (KR) ..... 10-2005-0092410

(51) Int. Cl.
*G09G 3/32* (2006.01)

(52) U.S. Cl. ..... 345/82

(58) Field of Classification Search ..... 345/76–82
See application file for complete search history.

(56) References Cited

U.S. PATENT DOCUMENTS

| | | | | |
|---|---|---|---|---|
| 6,680,580 | B1 | 1/2004 | Sung | |
| 6,778,151 | B2 | 8/2004 | Li | |
| 6,836,264 | B2 | 12/2004 | Shih | |
| 7,259,737 | B2 * | 8/2007 | Ono et al. | 345/82 |
| 7,274,345 | B2 * | 9/2007 | Imamura et al. | 345/76 |
| 2003/0112205 | A1 * | 6/2003 | Yamada | 345/32 |
| 2003/0210212 | A1 | 11/2003 | Li et al. | |
| 2004/0051690 | A1 | 3/2004 | Chang | |
| 2005/0007319 | A1 * | 1/2005 | Shin et al. | 345/76 |
| 2007/0008250 | A1 * | 1/2007 | Hoppenbrouwers et al. | 345/76 |

FOREIGN PATENT DOCUMENTS

| | | | |
|---|---|---|---|
| JP | 2002-207451 | A1 | 7/2002 |
| JP | 2002-358048 | A1 | 12/2002 |
| JP | 2003-255895 | A1 | 9/2003 |
| JP | 2004-145300 | A1 | 5/2004 |
| JP | 2004-252104 | A1 | 9/2004 |
| JP | 2005-004173 | A1 | 1/2005 |
| JP | 2005-004174 | A1 | 1/2005 |
| JP | 2005-031598 | A1 | 2/2005 |
| JP | 2005-099715 | A1 | 4/2005 |

(Continued)

*Primary Examiner*—Bipin Shalwala
*Assistant Examiner*—Steven E Holton
(74) *Attorney, Agent, or Firm*—H.C. Park & Associates, PLC

(57) ABSTRACT

A display apparatus includes a plurality of pixels arranged in a matrix. Each pixel includes a light emitting device, a driving transistor for supplying a driving current to the light emitting device, a first switching transistor coupled with the control terminal of the driving transistor to transmit a data voltage, and a second switching transistor coupled with the control terminal of the driving transistor to transmit a reverse voltage. The first and second switching transistors are alternately coupled with scanning lines driven by one of two scanning drivers, and are alternately turned on at different times. The display apparatus periodically applies the reverse voltage to the driving transistors to turn off the diving transistors and to compensate for variation of the threshold voltage of the driving transistors.

14 Claims, 5 Drawing Sheets

FOREIGN PATENT DOCUMENTS

| | | | |
|---|---|---|---|
| JP | 2005-099764 | A1 | 4/2005 |
| KR | 1020020018264 | A1 | 3/2002 |
| KR | 1020030073116 | A1 | 9/2003 |
| KR | 1020030094721 | A1 | 12/2003 |
| KR | 1020040019207 | A1 | 3/2004 |
| KR | 1020040033679 | A1 | 4/2004 |
| KR | 1020040067029 | A1 | 7/2004 |

* cited by examiner

DISPLAY APPARATUS AND DRIVING METHOD THEREOF

CROSS REFERENCE TO RELATED APPLICATION

This application claims priority to and the benefit of Korean Patent Application No. 10-2005-0092410, filed on Sep. 30, 2005, which is hereby incorporated by reference for all purposes as if fully set forth herein.

BACKGROUND OF THE INVENTION

1. Field of the Invention

The present invention relates to a display apparatus and a driving method thereof, and more specifically, to an organic light emitting diode device and a driving method thereof 2. Discussion of the Background Recently, research has been conducted into flat display devices that are capable of replacing cathode ray tube (CRT) display devices. One type of flat display apparatus, the organic light emitting diode (OLED) device, has a wide viewing angle and high quality brightness. Therefore the OLED device is being developed as a next generation flat display device.

In active matrix flat display devices, a plurality of pixels may be arranged along rows and columns of a matrix, and an intensity of light emitting from the pixels may be controlled according to information signals. When the information signals are transmitted to the pixels, light with a brightness corresponding to the data in the information signals is emitted from a plurality of pixels on the flat display device. From a viewer's perspective, the light coming from the flat display device forms an image. The OLED device is a display device that electrically excites phosphorous organic electroluminescent materials to emit light, thus forming an image on the display device. As a self-emitting apparatus with low power consumption, a wide viewing angle, and a high response speed, the OLED device can display a high quality moving image.

The OLED device includes organic light emitting diodes (OLEDs) and thin film transistors (TFTs) that control the signals driving the OLEDs. A TFT may be classified as a polysilicon TFT or an amorphous silicon TFT according to the type of active layer in the TFT. Due to several advantages, OLED devices employing the polysilicon TFTs have been generally used. However, manufacturing processes for polysilicon TFTs can be complex, and thus, production costs may increase. In addition, it may be difficult to manufacture a large display device by using the OLED devices with polysilicon TFTs.

By using the OLED devices with amorphous silicon TFTs, a large screen may be more easily obtained. In addition, the number of production processes for the manufacture of an OLED device with amorphous silicon TFTs may be fewer than the number of production processes for an OLED device with polysilicon TFTs. However, because amorphous silicon TFTs in a pixel may continuously supply a current to the pixel's OLED, the threshold voltage of an amorphous silicon TFT may deteriorate. Further, even though a single data voltage may be applied, a deteriorated threshold voltage may result in non-uniform current flowing to the OLED in the pixel, so that the image quality of the OLED device may deteriorate.

The above information disclosed in this Background section is provided for the sole purpose of enhancing the understanding of the background of the present invention. Therefore, this Background section may contain information that does not form the prior art known in this country to a person of ordinary skill in the art.

SUMMARY OF THE INVENTION

This invention provides a display apparatus and driving method. In a first sub-frame of the driving method, an image is formed on a first half of the display apparatus pixels and in a second sub-frame, an image is formed on a second half of the display apparatus pixels in alternating rows.

Additional features of the invention will be set forth in the description which follows, and in part will be apparent from the description, or may be learned by practice of the invention.

The present invention discloses a display apparatus including a plurality of pixels arranged in a matrix. Each pixel of the plurality of pixels includes a light emitting device, a driving transistor for supplying a driving current to the light emitting device, a first switching transistor coupled with the driving transistor to transmit a data voltage, and a second switching transistor coupled with the driving transistor to transmit a reverse voltage. Further, the first switching transistor and the second switching transistor are turned on at different times.

The present invention also discloses a method of driving a display apparatus including a plurality of pixels arranged in a matrix, of which each pixel includes a light emitting device and a driving transistor for supplying a current to the light emitting device. The method includes first applying comprising applying a data voltage to the driving transistors of the pixels in a first pixel row and applying a reverse bias voltage to the driving transistors of the pixels in a second pixel row. The method also includes second applying comprising applying the data voltage to the driving transistors of the pixels in the second pixel row and applying the reverse bias voltage to the driving transistors of the pixels in the first pixel row.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
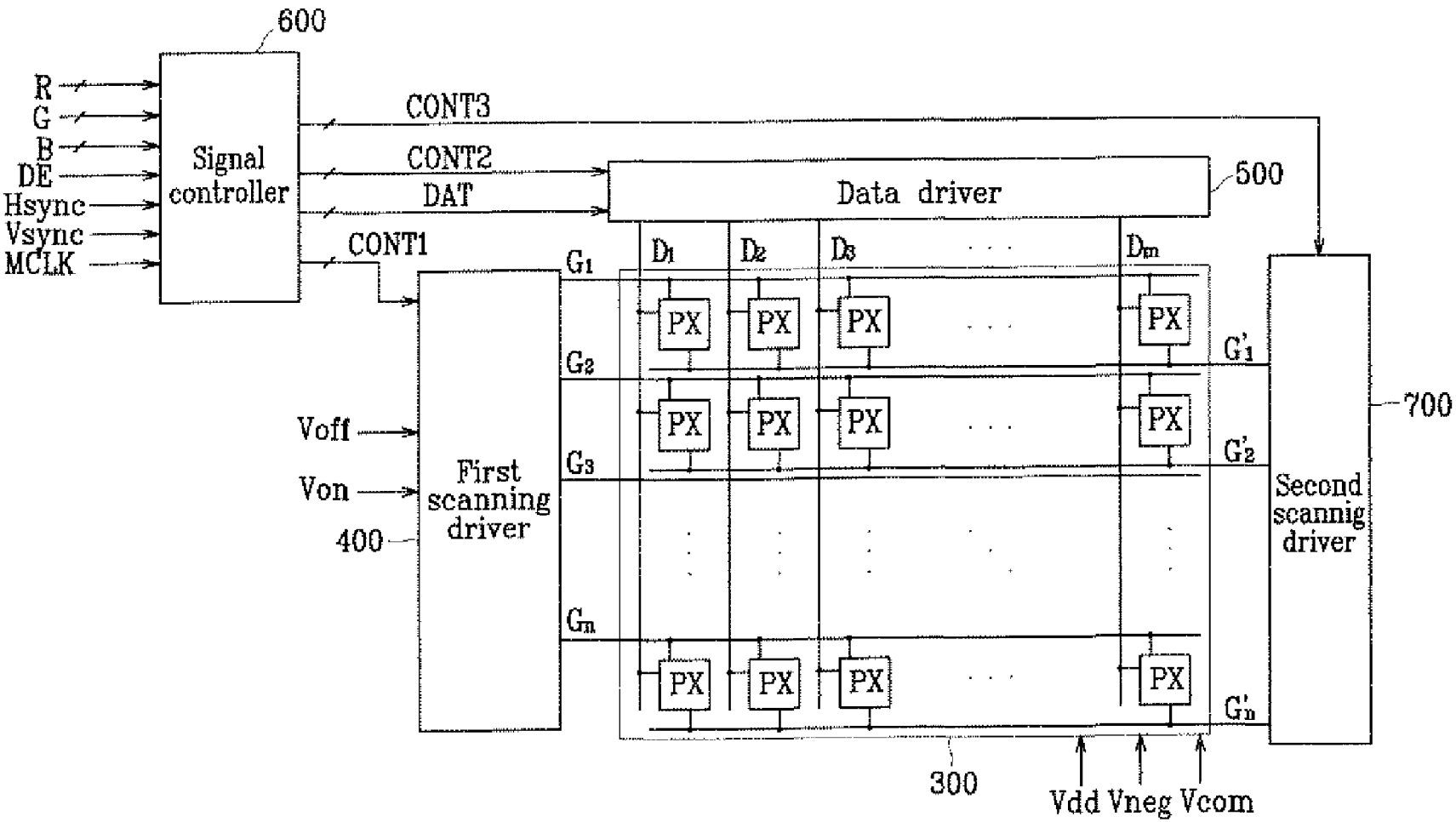
FIG. 1 shows a block diagram of an OLED device according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element such as a layer, film, region or substrate is referred to as being "on" another element, it can be directly on the other element or intervening elements may also be present. In contrast, when an element is referred to as being "directly on" another element, there are no intervening elements present.

Figure 2:
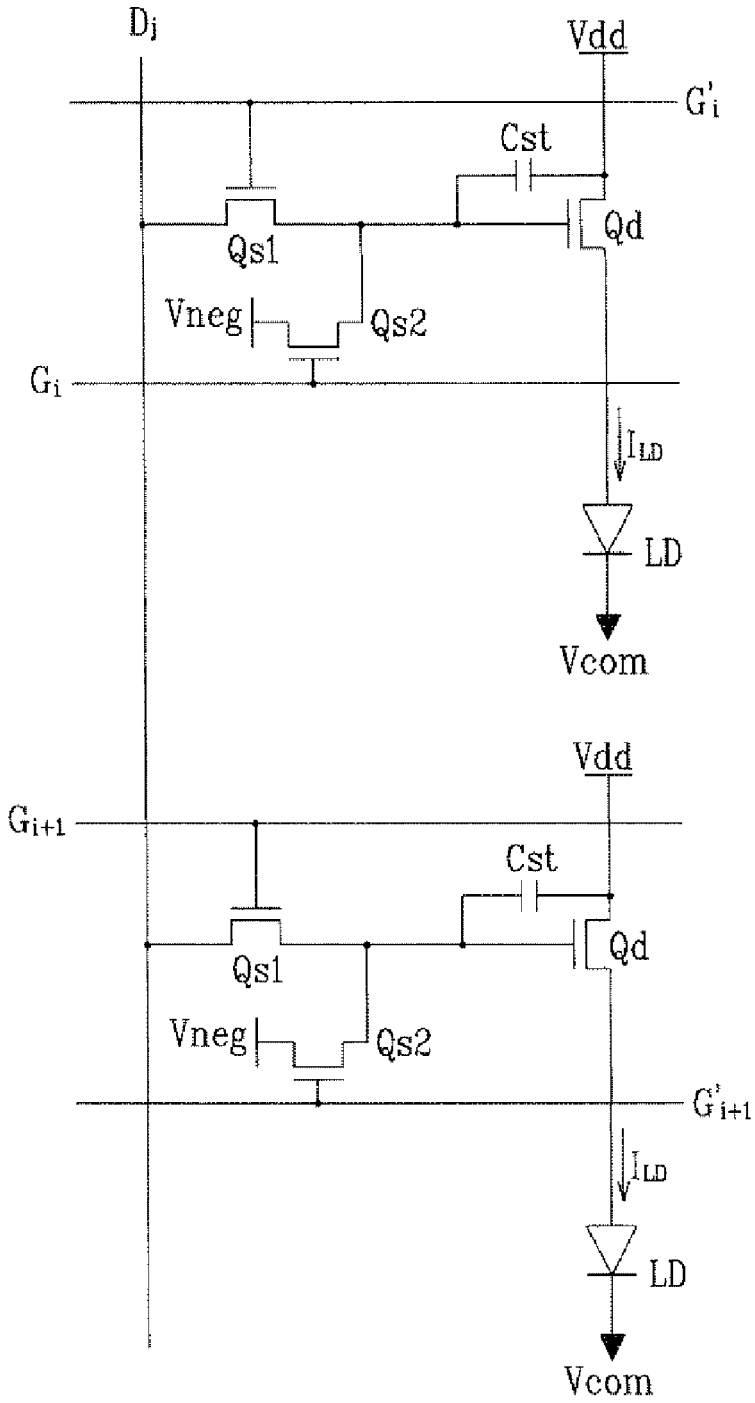
FIG. 2 shows an equivalent circuit diagram of a pixel in the OLED device according to an exemplary embodiment of the present invention.

FIG. 1 shows a block diagram of an OLED device according to an exemplary embodiment of the present invention, and FIG. 2 shows an equivalent circuit diagram of a pixel of the OLED device according to the exemplary embodiment of the present invention.

Referring to FIG. 1, the OLED device according to the exemplary embodiment of the present invention may include a display panel 300, a first scanning driver 400, a second scanning driver 700, a data driver 500, and a signal controller 600.

As seen in the equivalent circuit diagram, the display panel 300 may include a plurality of display signal lines $G_1$ to $G_n$, $G'_1$ to $G'_n$, and $D_1$ to $D_m$, a plurality of driving voltage lines (not shown), and a plurality of pixels PX that are arranged substantially in a matrix, and coupled with the display signal lines and the driving voltage lines. The pixels PX in the matrix may be arranged substantially in a plurality of rows and a plurality of columns.

The display signal lines $G_1$ to $G_n$, $G'_1$ to $G'_n$, and $D_1$ to $D_m$ include a plurality of first scanning signal lines $G_1$ to $G_n$, a plurality of second scanning signal lines $G'_1$ to $G'_n$, each of which transmit scanning signals, and a plurality of data lines $D_1$ to $D_m$ that transmit data voltages. The first scanning signal lines $G_1$ to $G_n$ and second scanning signal lines $G'_1$ to $G'_n$, may extend substantially horizontally in the row direction, may extend substantially parallel to each other, and may be separated from each other. The data lines $D_1$ to $D_m$ may extend substantially vertically in the column direction, may extend substantially parallel to each other, and may be separated from each other.

The driving voltage lines may transmit driving voltages, such as Vdd, to the pixels PX.

Referring to FIG. 2, each pixel PX, for example pixel PX of the i-th row (i=1, 2, . . . , n) and the j-th column (j=1, 2, . . . , m), may include an organic light emitting device LD, a driving transistor Qd, a capacitor Cst, a first switching transistor Qs1 and a second switching transistor Qs2.

An input terminal of the driving transistor Qd may be coupled with driving voltage Vdd, and an output terminal thereof may be coupled with a first electrode, which may be an anode, of the organic light emitting device LD. A control terminal of the driving transistor Qd may be coupled with an output terminal of the first switching transistor Qs1 and the output terminal of second switching transistor Qs2.

An input terminal of the first switching transistor Qs1 may be coupled with the data line Dj, and an output terminal thereof may be coupled with a control terminal of the driving transistor Qd. A control terminal of the first switching transistor Qs1 may be coupled with the second scanning signal line G'i.

An input terminal of the second switching transistor Qs2 may be coupled with a reverse bias voltage Vneg, and an output terminal thereof may be coupled with the control terminal of the driving transistor Qd. The control terminal of the second switching transistor Qs2 may be coupled with the first scanning signal line $G_i$.

However, first switching transistor Qs1 and second switching transistor Qs2 of a first pixel PX are coupled with the first scanning signal line $G_i$ and the second scanning signal line $G'_i$ with connections opposite to those of a second pixel PX in the row immediately after the row of the first pixel PX. For example, the control terminal of the first switching transistor Qs1 of the second pixel PX in the (i+1)-th row may be coupled with the first scanning signal line $G_{i+}1$. Further, the control terminal of the second switching transistor Qs2 of the second pixel PX in the (i+1)-th row may be coupled with the second scanning signal line $G'_{i+1}$.

The capacitor Cst may be coupled between the control terminal and the input terminal of the driving transistor Qd. The capacitor Cst may be charged to a voltage equal to a voltage difference between the data voltage from the first switching transistor Qs1, transmitted from data line Dj, and the driving voltage Vdd.

The organic light emitting device LD may include an OLED. The first electrode of the OLED, which may be an anode, may be coupled with the output terminal of the driving transistor Qd. The second electrode of the OLED, which may be a cathode, may be coupled with a common voltage Vcom. The organic light emitting device LD may emit light with an intensity corresponding to an amount of a current $I_{LD}$ supplied from the output terminal of the driving transistor Qd, and the amount of the current $I_{LD}$ may depend on a magnitude of a voltage Vgs (not shown) equal to the voltage difference between the control terminal and the output terminal of the driving transistor Qd.

The switching transistors Qs1 and Qs2 and driving transistor Qd may be n-channel field effect transistors (FETS) made of amorphous silicon or polysilicon. Alternatively, switching transistors Qs1 and Qs2 and driving transistor Qd may be p-channel FETs. Since p-channel FETs and n-channel FETs are complementary to each other, the operation, voltage, and current of the p-channel FETs are opposite to those of the n-channel FETs.

Now, structures of the driving transistor Qd and the organic light emitting device LD of the OLED device shown in FIG. 2 will be described in detail with reference to FIG. 3 and FIG. 4.

Figure 3:
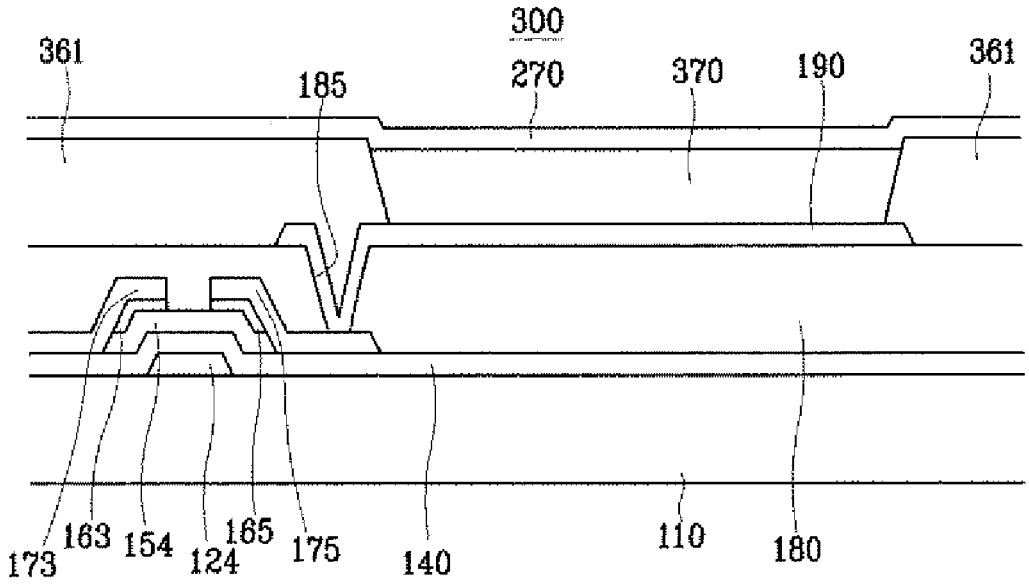
FIG. 3 shows a cross-sectional view of a driving TFT and an OLED of a pixel of the OLED device according to an exemplary embodiment of the present invention.
Figure 4:
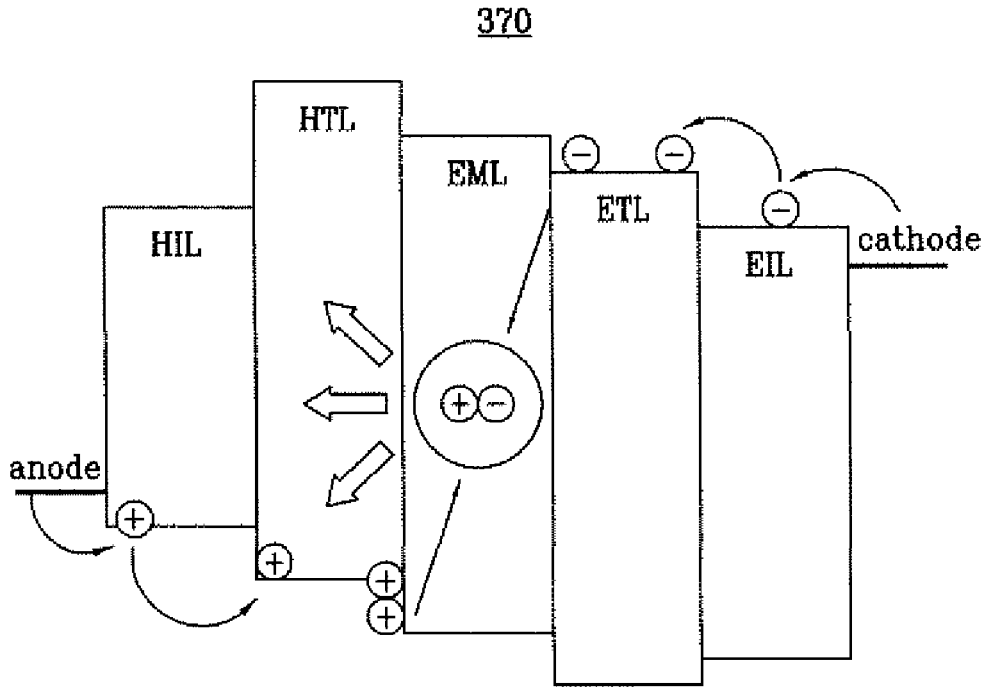
FIG. 4 shows a schematic view of an OLED of the OLED device according to an exemplary embodiment of the present invention.

FIG. 3 shows a cross-sectional view of a driving transistor and an organic light emitting device of a pixel of the OLED device shown in FIG. 2, and FIG. 4 shows a schematic view of an organic light emitting device of the OLED device according to an exemplary embodiment of the present invention.

A control electrode 124 may be arranged on an insulating substrate 110. The control electrode 124 may be formed of an aluminum-based metal such as aluminum (Al) and an aluminum alloy, a silver-based metal such as silver (Ag) and a silver alloy, a copper-based metal such as copper (Cu) and a copper alloy, a molybdenum-based metal such as molybdenum (Mo) and a molybdenum alloy, chromium (Cr), titanium (Ti), or tantalum (Ta). Additionally, the control electrode 124 may have a multi-layered structure including two or more conductive layers (not shown) having different physical properties. Where at least two layers are included in control electrode 124, one conductive layer may be formed of a metal having low resistivity, for example an aluminum-based metal, a silver-based metal, or a copper-based metal, in order to reduce signal delay or voltage drop. Another conductive layer may be formed of a material such as a molybdenum-based metal, chromium, titanium, and tantalum having good physical, chemical, and electrical contact characteristics with other materials, particularly to ITO (indium tin oxide) and IZO (indium zinc oxide).

As an example, control electrode 124 having a multi-layered structure may include a lower chromium layer and an upper aluminum (alloy) layer, or a combination of a lower aluminum (alloy) layer and an upper molybdenum (alloy) layer. However, the control electrode 124 may be made of various metals and conductive materials. The control electrode 124 may be angled with respect to a surface of the substrate 110, and the angle may be in a range of about 30° to about 80°.

An insulating layer 140 made of, for example, a silicon nitride SiNx may be arranged on the control electrode 124.

A semiconductor 154 made of hydrogenated amorphous silicon (abbreviated as a-Si) or polysilicon may be arranged on the insulating film 140.

A pair of ohmic contacts 163 and 165 made of silicide or an n+hydrogenated amorphous silicon heavily doped with n-type impurities may be arranged on the semiconductor 154.

Side surfaces of the semiconductor 154 and the ohmic contacts 163 and 165 may be angled with respect to a surface of the substrate 110, and the angle may be in a range of about 30° to about 80°.

An input electrode 173 may be arranged on ohmic contact 163 and insulating film 140. An output electrode 175 may be arranged on ohmic contact 165 and the insulating film 140. The input electrode 173 and the output electrode 175 may each be formed of chromium, a molybdenum-based metal, or a refractory metal, such as tantalum or titanium, and may have a multi-layered structure constructed with a lower layer (not shown) including the refractory metal and an upper layer (not shown) including a low resistance material disposed thereon. As an example of the multi-layered structure, the input electrode 173 or the output electrode 175 may be a two-layered structure having a lower layer formed of chromium or molybdenum (alloy) and an upper layer formed of aluminum. As another example of the multi-layered structure, the input electrode 173 or the output electrode 175 may be a three-layered structure having a lower layer formed of molybdenum (alloy), an intermediate layer formed of aluminum (alloy), and an upper layer formed of molybdenum (alloy). Similar to the control electrode 124, side surfaces of the input electrode 173 and the output electrode 175 may be angled with respect to a surface of the substrate 110, and the angle may be in a range of about 30° to about 80°.

The input electrode 173 and the output electrode 175 may be separated from each other and disposed at opposite sides of the control electrode 124. The control electrode 124, the input electrode 173, and the output electrode 175 together with the semiconductor 154 constitute the driving transistor Qd, and a channel thereof may be formed in the semiconductor 154 between the input electrode 173 and the output electrode 175.

The ohmic contact 163 may be interposed between the underlying semiconductor 154 and the overlying input electrode 173, and has a function of reducing contact resistance between the input electrode 173 and the semiconductor layer 154. Similarly, the ohmic contact 165 may be interposed between the underlying semiconductor 154 and the overlying output electrode 175, and has a function of reducing contact resistance between the output electrode 175 and the semiconductor layer 154. The semiconductor 154 may have an exposed portion uncovered between the input electrode 173 and the output electrode 175.

A protective film (passivation layer) 180 may be arranged on the input electrode 173, the output electrode 175, the exposed portion of the semiconductor 154, and the insulating film 140. The protective film 180 may be formed of an inorganic insulating material or organic insulating material. An upper surface of the protective film 180 may be planarized. Examples of the inorganic insulating material may include silicon nitride and silicon oxide. The organic insulating material may have photosensitivity, and the dielectric constant of the organic insulating material may be 4.0 or less. In order to use the excellent properties of an organic insulating material and protect the exposed portion of the semiconductor 154, the protective film 180 may include a two-layered structure of a lower inorganic insulating material and an upper organic insulating material.

A pixel electrode 190 may be arranged on the protective film 180. The pixel electrode 190 may be physically and electrically coupled with the output electrode 175 through a contact hole 185 in the protection film 180, and may be formed of a transparent conductive material such as ITO and IZO or a metal having an excellent reflectance such as aluminum or a silver alloy.

In addition, partition walls 361 may be arranged on the protective film 180. The partition walls 361 may surround the pixel electrode 190 like a bank to define an opening, and may be formed of an organic insulating material or inorganic insulating material.

An organic light emitting device 370 may be arranged on the pixel electrode 190, and the organic light emitting device 370 may be enclosed by the partition walls 361.

As shown in FIG. 4, the organic light emitting device 370 may have a multi-layered structure including a light emitting layer (EML) and auxiliary layers for improving light emitting efficiency of the light emitting layer. The auxiliary layers may include an electron transport layer (ETL) and a hole transport layer (HTL) that balance electrons and holes, and an electron injecting layer (EIL) and a hole injecting layer (HIL) that enhance injection of the electrons and the holes. All or a portion of the auxiliary layers may be omitted.

A common electrode 270 applied with a common voltage Vcom may be arranged on the partition walls 361 and the organic light emitting device 370. The common electrode 270 may be formed of a reflective metal such as calcium (Ca), barium (Ba), or aluminum (Al), or a transparent conductive material such as ITO and IZO. Additionally, common electrode 270 may be formed to correspond to a single row of pixels or a single column of pixels. Alternatively, an OLED device of an exemplary embodiment of the present invention may have a second electrode formed on organic light emitting device 370 wherein the second electrode may correspond to a single pixel or to a single sub-pixel of the OLED device.

An opaque pixel electrode 190 and a transparent common electrode 270 may be employed in a top emission type of OLED device where an image is displayed in an upward direction of the display panel 300. A transparent pixel electrode 190 and an opaque common electrode 270 may be employed in a bottom emission type of OLED device where an image is displayed in a downward direction of the display panel 300.

The pixel electrode 190, the organic light emitting device 370, and the common electrode 270 constitute the organic light emitting device LD shown in FIG. 2. The pixel electrode 190 may be the anode and the common electrode 27 may be the cathode. Alternatively, the pixel electrode 190 may be the cathode and the common electrode 27 may be the anode. The organic light emitting device LD may emit light of a primary color depending on a material of the organic light emitting device 370. The primary color may be red, green, or blue. A desired color other than a primary color may be obtained by a spatial combination light emission of more than one primary color from more than one sub-pixel.

Returning to FIG. 1, the first scanning driver 400 is coupled with the first scanning signal lines $G_1$ to $G_n$. The second scanning driver 700 is coupled with the second scanning signal lines $G'_1$ to $G'_n$, The first scanning driver 400 and the second scanning driver 700 apply a scanning signal formed of a combination of high voltages Von and low voltages Voff to the scanning lines $G_1$ to $G_n$ and $G'_1$ to $G'_n$, to turn the switching transistors Qsl and Qs2 on and off.

The data driver 500 is coupled with the data lines D1 to Dm to apply the data voltage to the data lines D1 to Dm. The first scanning driver 400, the second scanning driver 700, the data driver 500, or a combination thereof may be directly mounted on the display panel 300 in a form of at least one driving IC chip. Alternatively, first scanning driver 400, the second scanning driver 700, the data driver 500, or a combination thereof may be attached as a tape carrier package (TCP) on a flexible printed circuit film (not shown) in the display panel 300. Alternatively, first scanning driver 400, the second scanning driver 700, the data driver 500, or a combination thereof may be arranged together with the signal lines and the transistors on the display panel 300 to constitute a system-on-panel (SOP).

The signal controller 600 may control operations of the first scanning driver 400, the second scanning driver 700, and the data driver 500.

The signal controller 600 may receive input image signals R, G, and B and input control signals for controlling display thereof from an external graphics controller (not shown). The input control signals may include a vertical synchronization signal Vsync, a horizontal synchronization signal Hsync, a main clock signal MCLK, and a data enable signal DE. The signal controller 600 processes the image signals R, G, and B according to an operating condition of the display panel 300 based on the input control signals and the input image signals R, G, and B to generate a first scanning control signal CONT1, a data control signal CONT2, a processed image signal DAT, and a second scanning control signal CONT3. The signal controller 600 then transmits the generated first scanning control signals CONT1 to the first gate driver 400, the generated second scanning control signal CONT3 to the second gate driver 700, and transmits the generated data control signal CONT2 and the processed image signal DAT to the data driver 500.

The first scanning control signal CONT1 and the second scanning control signal CONT3 may each include a vertical synchronization start signal STV for indicating scan start of the high voltage Von, and at least one clock signal CLK for controlling an output of the high voltage Von. The first scanning control signal CONT1 and the second scanning control signal CONT3 may each include an output enable signal OE for defining a duration of the high voltage Von.

The data control signal CONT2 may include a horizontal synchronization start signal STH for indicating data transmission for one pixel row, a load signal LOAD for instructing the data driver 500 to apply the associated data voltages to the data lines D1 to Dm, and a data clock signal HCLK.

Hereinafter, referring to FIG. 5 and FIG. 6, an operation of an OLED device according to an exemplary embodiment of the present invention will be described in detail.

Figure 5:
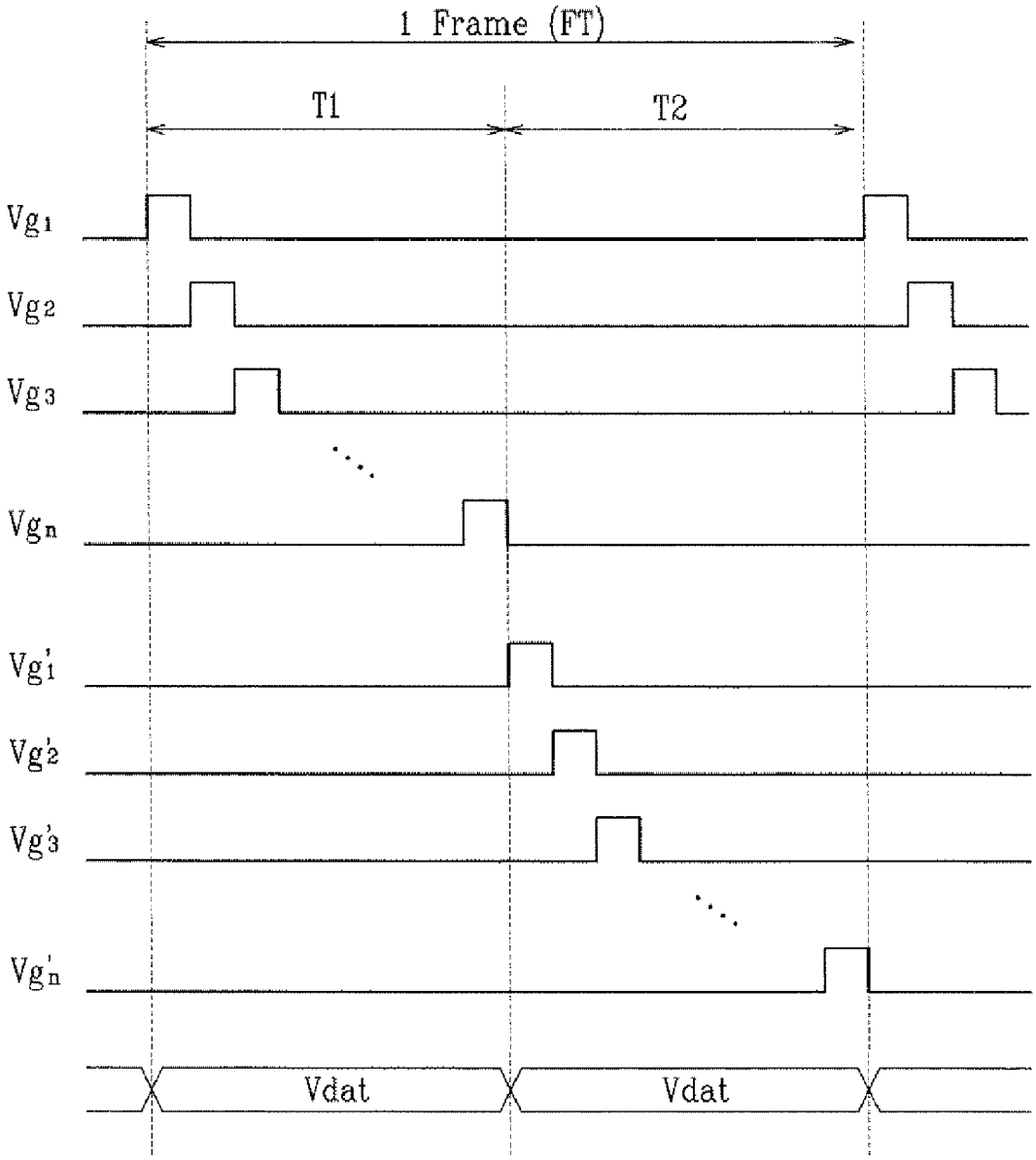
FIG. 5 shows a wave form chart illustrating an operation of an OLED device according to an exemplary embodiment of the present invention.

FIG. 5 shows a wave form chart illustrating an operation of an OLED device according to the exemplary embodiment of the present invention shown, for example, in FIG. 2.

As shown in FIG. 5, the signal controller 600 may divide one frame 1FT into a first sub-frame T1 and a second sub-frame T2 to display an image.

First, in a first sub-frame T1, the data driver 500 may convert a digital image signal DAT into an analog data voltage Vdat and may apply the analog data voltage Vdat to the corresponding data lines $D_1$ to $D_m$.

In the first sub-frame T1, the first scanning driver 400 may change a level of a scanning signal $Vg_i$ applied to an odd-numbered line, for example the i-th line $G_i$ of the first scanning signal lines, into a high level Von in response to the first scanning control signal CONT1 from the signal controller 600. The second switching transistor Qs2's control terminal coupled with the i-th line $G_i$ of the first scanning signal lines and is turned on by the high-level scanning signal Von to apply a reverse bias voltage Vneg to the control terminal of the driving transistor Qd. Additionally, capacitor Cst is charged to the corresponding voltage. Then, the reverse bias voltage Vneg may turn off the driving transistor Qd and may have a polarity opposite to that of the data voltage Vdat. The reverse bias voltage may be equal to or less than 0V.

The second scanning driver 700 can maintain the voltage level of the scanning signal $V'g_i$ applied to the i-th line $G'_i$ of the second scanning signal lines as the low level Voff. The first switching transistor Qsl's control terminal is coupled with the second scanning signal line $G'_i$ and is turned off when low level signal Voff is applied. Thus, the data voltage Vdat applied to the data line $D_j$ is not transmitted to the driving transistor Qd.

Accordingly, the driving transistor Qd is turned off and does not output the driving current ILD to the organic light emitting device LD. Accordingly, a pixel PX in the odd-numbered row does not emit light during first sub-frame T1.

Next, the first scanning driver 400 may change a level of a scanning signal applied to an even-numbered line, for example the (i+1)-th line $G_{i+1}$ of the first scanning signal lines, into a high level signal Von. The first switching transistor Qs1 connected to the (i+1)-th line $G_{i+1}$ of the first scanning signal lines is turned on to transmit a data voltage Vdat from data line $D_j$ to the control terminal of the driving transistor Qd and charge the capacitor Cst to the corresponding voltage.

Concurrently, the second scanning driver 700 can maintain the voltage level of the scanning signal $V'g_{i+}$applied to the (i+1)-th line $G'_{i+1}$ of the second scanning signal lines as the low level Voff. Since the second switching transistor Qs2 connected to the second scanning signal line $G'_i$ is turned off when low level signal Voff is applied, the reverse bias voltage Vneg is not transmitted to the driving transistor Qd.

Accordingly, the driving transistor Qd outputs the driving current $I_{LD}$ according to the data voltage Vdat to the anode of the organic light emitting device LD. The organic light emitting device LD emits light with a level of brightness that corresponds to the applied driving current $I_{LD}$. Accordingly, a pixel PX in the even-numbered row emits light during first sub-frame T1.

The aforementioned operations are thus repeated for all pixels in the matrix to the last pixel row.

Therefore, when the reverse bias voltage Vneg is applied to the control terminal of the driving transistor Qd, it is possible to reduce variation in the driving transistor Qd's threshold voltage. Specifically, the reverse bias voltage Vneg may be applied to the control terminal of the driving transistor Qd to turn off the driving transistor Qd and reduce the stress caused by the continuous driving of current.

When the first sub-frame T1 ends and the second sub-frame T2 starts, the data diver 500 may convert the digital image signal DAT into the analog data voltage Vdat again and transmit the analog data voltage Vdat to the corresponding data lines $D_1$ to $D_m$. Then, the analog data voltage Vdat of the second sub-frame T2 is the same as that of the first sub-frame.

The second scanning driver 700 may change a level of a scanning signal $V'g_i$ applied to the second scanning signal line $G'_i$ into a high level Von in response to the second scanning control signal CONT3 of the signal controller 600. Concurrently, the first scanning driver 400 can maintain a level of scanning signal $Vg_i$ applied to the first scanning signal line $G_i$ at a low level Voff in response to the first scanning control signal CONT1 of the signal controller 600. Accordingly, a pixel PX in the odd-numbered row emits light and a pixel PX in the even-numbered row does not emit light during second sub-frame T2.

The driving transistor Qd of the odd-numbered row and the organic light emitting device LD are driven in the second sub-frame T2 and halt operation in the first sub-frame T1, and the driving transistor Qd of the even-numbered row and the organic light emitting device LD are driven in the first sub-frame T1 and halt operation in the second sub-frame T2.

In another exemplary embodiment of the present invention, the first sub-frame and second sub-frame may be the same. In addition, when the frame frequency of the input image signals R, G, and B is 60 Hz, the signal controller 600 may transmit the output digital image data DAT to the data driver 500 at a frame frequency of 120 Hz.

Figure 6:
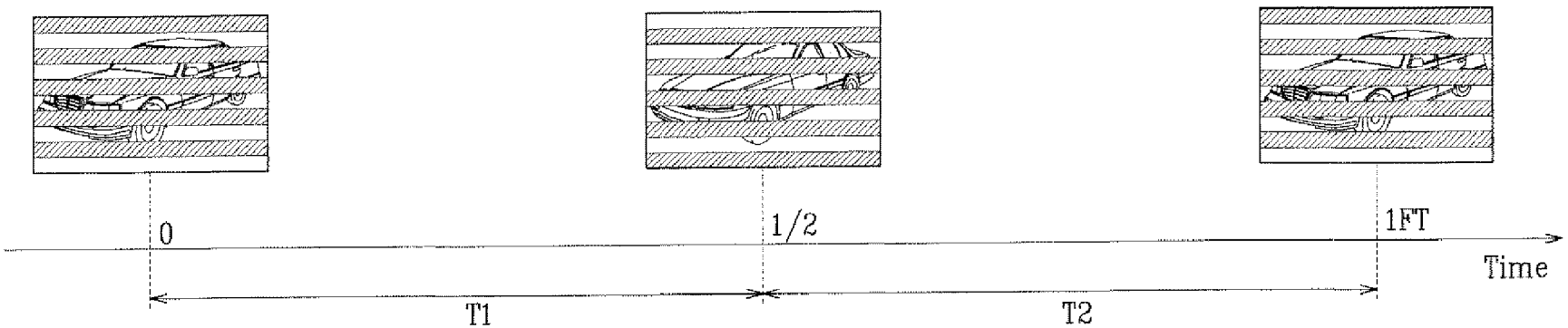
FIG. 6 shows a schematic view of a screen of the OLED device on which an image is displayed according to FIG. 5.

FIG. 6 shows a schematic view of a screen of the OLED device that displays an image according to the driving method shown in FIG. 5.

Referring to FIG. 6, at the start of first sub-frame T1, no light is emitted from pixels in the even-numbered pixel rows. Accordingly, only a black image is displayed on the even-numbered pixel rows since the reverse bias voltage Vneg is applied to the control terminal of driving transistor Qd, turning driving transistor Qd off. When the first sub-frame T1 starts and driving transistors Qd in even-numbered pixel rows are turned on, the image according to the data voltage Vdat is displayed on the even-numbered pixel rows from the top portion of the screen, and the black image according to the reverse bias voltage Vneg is displayed on the odd-numbered pixel rows.

Accordingly, during sub-frame T1, which may be half of frame 1FT, the image is displayed on the even-numbered pixel rows of the entire screen.

Next, when the second sub-frame T2 starts, the black image according to the reverse bias voltage Vneg is displayed on the even-numbered pixel rows from the top portion of the screen, and the image according to the data voltage Vdat is displayed on the odd-numbered pixel rows.

A pixel PX may emit light after the data voltage Vdat is applied to the control terminal of driving transistor Qd until the reverse bias voltage Vneg is applied to the control terminal of driving transistor Qd. After the reverse bias voltage is applied, the pixel may not emit light until the data voltage Vdat of the next frame is applied. Accordingly, since the pixels do not emit light for a half of one frame 1 FT, it is possible to prevent a blurring phenomenon that results in an unclear image on the screen.

As described above, since the reverse voltage is applied to the alternate rows, it is possible to prevent variation of the threshold voltage of the driving transistors Qd and prevent the blurring phenomenon by an impulsive effect.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display apparatus comprising:

a light emitting element;

a driving transistor for the light emitting element;

a first switching transistor coupled with the driving transistor to transmit a data voltage; and a second switching transistor coupled with the driving transistor to transmit a reverse voltage;

a first pixel including the first switching transistor and the second switching transistor, and the first pixel emits light when the first switching transistor is turned on for a first time period;

a second pixel including a third switching transistor and a fourth switching transistor, and the second pixel emits light when the third switching transistor is turned on for a second time period that is different from the first time period;

a first group of scanning signal lines, a first scanning signal line in the first group of scanning signal lines is coupled with the first switching transistor, and a second scanning signal line in the first group of scanning signal lines is coupled with the fourth switching transistor;

a second group of scanning signal lines, a first scanning signal line in the second group of scanning signal lines is coupled with the second switching transistor, and a second scanning signal line in the second group of scanning signal lines is coupled with the third switching transistor;

a first scanning driver to sequentially apply a first voltage for turning on switching transistors coupled with scanning signal lines of the first group of scanning signal lines; and a second scanning driver to sequentially apply a second voltage for turning on the switching transistors coupled with scanning signal lines of the second group of scanning signal lines.

2. The display apparatus of claim 1, wherein the first switching transistor and the second switching transistor are alternately turned on.

3. The display apparatus of claim 1, wherein the first time period and the second time period are alternately repeated.

4. The display apparatus of claim 3, wherein the first pixel is arranged in a first row of pixels, the second pixel is arranged in a second row of pixels, and the first row and the second row are arranged adjacent to each other.

5. The display apparatus of claim 4, wherein the second scanning driver sequentially applies the first voltage to the scanning signal lines of the second group of scanning signal lines after the first scanning driver has sequentially applied the first voltage to all the scanning signal lines of the first group of scanning signal lines.

6. The display apparatus of claim 5, wherein a duration of the first time period is substantially the same as a duration of the second time period.

7. The display apparatus of claim 6, further comprising:

a data line coupled with the first switching transistor to transmit a data voltage to the first pixel; and a data driver coupled with the data line to generate the data voltage and apply the data voltage to the data line.

8. The display apparatus of claim 7, wherein the data driver sequentially applies substantially the same data voltage to the data line twice.

9. The display apparatus of claim 1, wherein the reverse voltage has a level to turn off the driving transistor.

10. The display apparatus of claim 1, wherein the display apparatus comprises an organic light emitting diode device.

11. The display apparatus of claim 1, wherein a semiconductor layer of the driving transistor, the first switching transistor, or the second switching transistor comprises amorphous silicon.

12. The display apparatus of claim 1, wherein the first switching transistor is coupled with a control terminal of the driving transistor, and the second switching transistor is coupled with the control terminal of the driving transistor.

13. The display apparatus of claim 1, wherein the reverse voltage has a polarity opposite to that of the data voltage.

14. A display apparatus comprising:

a light emitting element;

a driving transistor for the light emitting element;

a first switching transistor coupled with the driving transistor to transmit a data voltage;

a second switching transistor coupled with the driving transistor to transmit a reverse voltage;

a first pixel including the first switching transistor and the second switching transistor, and the first pixel emits light when the first switching transistor is turned on for a first time period;

a second pixel including a third switching transistor and a fourth switching transistor, and the second pixel emits light when the third switching transistor is turned on for a second time period that is different from the first time period;

a first group of scanning signal lines, a first scanning signal line in the first group of scanning signal lines is coupled with the first switching transistor, and a second scanning signal line in the first group of scanning signal lines is coupled with the fourth switching transistor;

a second group of scanning signal lines, a first scanning signal line in the second group of scanning signal lines is coupled with the second switching transistor, and a second scanning signal line in the second group of scanning signal lines is coupled with the third switching transistor;

a first scanning driver to sequentially apply a first voltage for turning on switching transistors coupled with scanning signal lines of the first group of scanning signal lines; and a second scanning driver to sequentially apply a second voltage for turning on the switching transistors coupled with scanning signal lines of the second group of scanning signal lines, wherein the first switching transistor and the second switching transistor are turned on at different times.

* * * * *